United States Patent [19]

Oda

[11] 4,196,584

[45] Apr. 8, 1980

[54] TIME CORRECTING DEVICE FOR ELECTRONIC TIMEPIECE

[75] Inventor: Hajime Oda, Tokyo, Japan

[73] Assignee: Kabushiki Kaisha Seikosha, Japan

[21] Appl. No.: 874,625

[22] Filed: Feb. 2, 1978

[30] Foreign Application Priority Data

Feb. 9, 1977 [JP] Japan ..... 52-13343

[51] Int. Cl.[2] ..... G04B 27/00; G04C 3/00

[52] U.S. Cl. ..... 368/187

[58] Field of Search ..... 58/4 A, 23 R, 50 R, 58/57, 85.5

[56] References Cited

U.S. PATENT DOCUMENTS

| | | | |
|---|---|---|---|
| 4,086,755 | 5/1978 | Ueda | 58/85.5 |
| 4,091,612 | 5/1978 | Meisner | 58/85.5 |

*Primary Examiner*—Edith S. Jackmon

*Attorney, Agent, or Firm*—Robert E. Burns; Emmanuel J. Lobato; Bruce L. Adams

[57] ABSTRACT

A pulse generating means is adapted to be rotated in either direction by a manual operation and to produce a plurality of trains of pulse signals the frequencies of which are varied in accordance with the speed of rotation. The pulse trains have different phase differentials which are inverted when the direction of the rotation of the pulse generating means is reversed. Either the up counting mode or the down counting mode of an up-and-down counter is selected in accordance with the output from the pulse generating means, so as to correct the contents of the counter by an addition or a subtraction.

7 Claims, 10 Drawing Figures

TIME CORRECTING DEVICE FOR ELECTRONIC TIMEPIECE

BACKGROUND OF THE INVENTION

The present invention relates to a correcting device for electronic timepieces.

In conventional electronic digital clocks, the correction of the time display is made through putting the clock only either ahead or aback. In most cases, the putting ahead or aback of the clock is effected by depressing a push button. Various types of mechanisms have been proposed and used for this purpose. A typical one of these mechanisms is adapted to put the clock one minute ahead at each time of depression of the push button, while another type of mechanism is adapted to forward the time display at a constant speed while the push button is kept depressed. In some electronic digital clocks, the above stated two types of mechanisms are suitably combined. Also, there are electronic digital clocks in which a switch is provided for varying the speed of the forwarding of the time display.

However, the first mentioned type mechanism is impractical because it requires 59 times of depression of the push button at the maximum, for adjusting the place of minute. Also, in the mechanism of the second mentioned type, it is necessary to keep the push button depressed for 59 seconds at the longest, if the forwarding is made at a speed of one minute ahead per second. Also, it is often experienced that the time display goes too far, beyond the destined time, when the forwarding of the time display is made too fast.

SUMMARY OF THE INVENTION

The present invention provides a device for correcting the time display of electronic timepieces, capable of affording a prompt correction or setting of the time display.

A major characteristic fearure of the invention resides in such a combination of an up-down counter with a pulse generating means which can be freely rotated ahead and aback by a manual operation, as to optionally cause the up and down counting of the counter. Thus, the content of the counter can be increased and decreased in quite a simple operation. In addition, the speed of correction can optionally be adjusted by a manual operation, so as to allow a prompt correction or setting of the time dispaly.

Another feature of the invention resides in that the pulse generating means constituted by a number of conductive sections of different phases formed on a rotary means and separately formed contact pieces, so as to produce a plurality of pulse trains by a simple construction.

A third feature of the invention resides in a construction for allowing the rotary body to move in an axial direction over a plurality of axial positions, so that the rotary means may produce pulse signals at different axial positions. The up-and-down counters whose contents are to be changed are optionally selected by selecting the axial position of the rotary means, so as to afford an optional correction and setting of the time display.

A fourth feature of the invention resides in a provision of a switch adapted to be opened and closed in accordance with the movement of the axial direction of the rotary means. A time reference signal and a time correcting signal can be selectively delivered to the up-and-down counter, by the output of the switch, so that the selection of either of the time counting and correcting functions can be performed promptly by a simply mechanism.

BRIEF DESCRIPTION OF THE DRAWINGS

The nature of the invention, as well as other objects and advantages thereof, will become more apparent from consideration of the following detailed description and the accompanying drawings in which.

DESCRIPTION OF THE PREFERRED EMBODIMENTS

A description of preferred embodiments of the present invention will be given hereinafter, in reference to the attached drawings.

Figure 1:
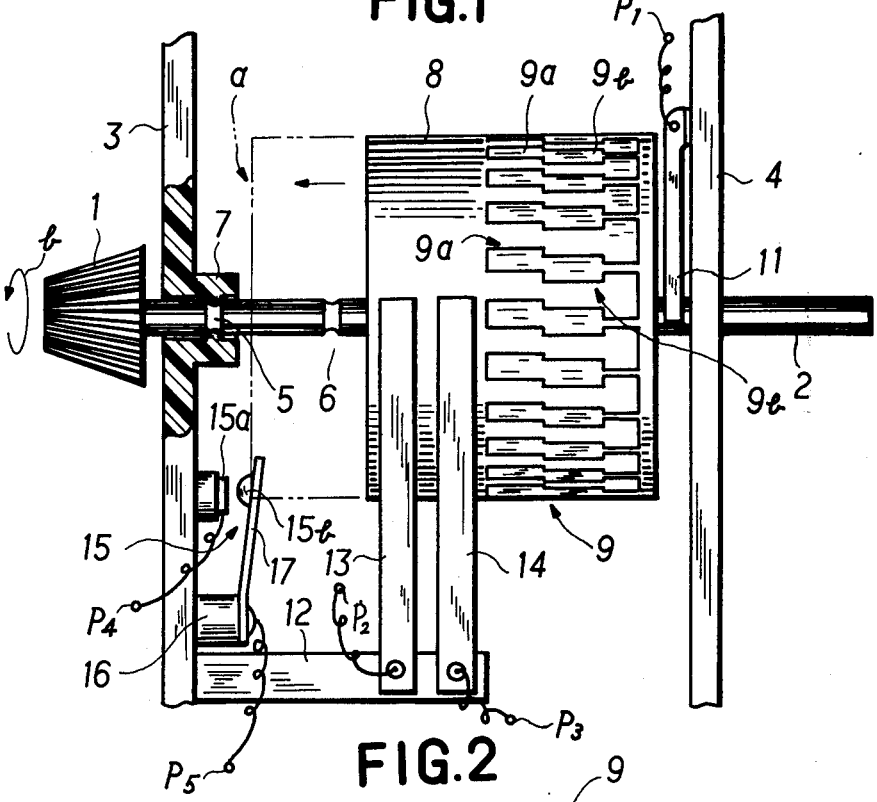
FIG. 1 is a partially-sectioned front elevational view of pulse generating means constituting a part of the embodiment of the invention.
Figure 2:
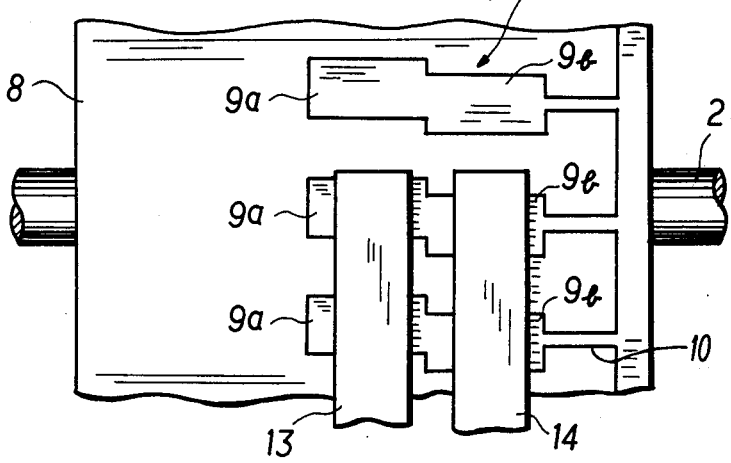
FIG. 2 is an enlarged front elevational view of an essential part of the embodiment as shown in FIG. 1.

Referring to FIGS. 1 and 2, a knob 1 is fixed to one end of a shaft 2. The shaft 2 is mounted on support plates 3, 4 for free rotation and for movement in the axial direction. The shaft 2 has click grooves 5, 6 adapted to engage claws 7, 7 provided on the support plate 3, thereby to fix the axial position of the shaft 2. A rotary body 8 made of an insulating material is fixed to the shaft 2. A plurality of conductive parts 9 . . . 9 are formed on the peripheral surface of the rotary body. Each of the conductive parts 9 . . . 9 has two conductive sections **9*a* and 9*b* which are unitary but slightly deviated from each other in the circumferential direction. The conductive parts 9 . . . 9 are lead to the shaft 2 through a lead 10 and connected to a source of electric power (not shown) through a brush 11 which is adapted to be kept in contact with the shaft 2 through a terminal $P_1$. The shaft 2 which stands up from the support plate 3 supports one ends of contact pieces 13, 14. When the shaft 2 is located at a predetermined position, the contact pieces 13, 14 contact at their ends the conductive sections 9*a* and 9*b*, respectively. The contact pieces 13 and 14** are grounded through terminals $P_2$ and $P_3$ and then, through resistors, respectively.

A switch 15 is constituted of a contact **15*a* and a contact 15*b* of which is provided on one end of a contact piece carried by one end of a column 16 which is supported at its other end by the support plate 3. The contact 15*a* is connected to the power source through a terminal $P_4$ and the contact 15*b* is grounded to a terminal $P_5$ through a resistor. The contact piece 17 is adapted to close the switch 15, when pressed by one side surface of the rotary body 8**.

Figure 3:
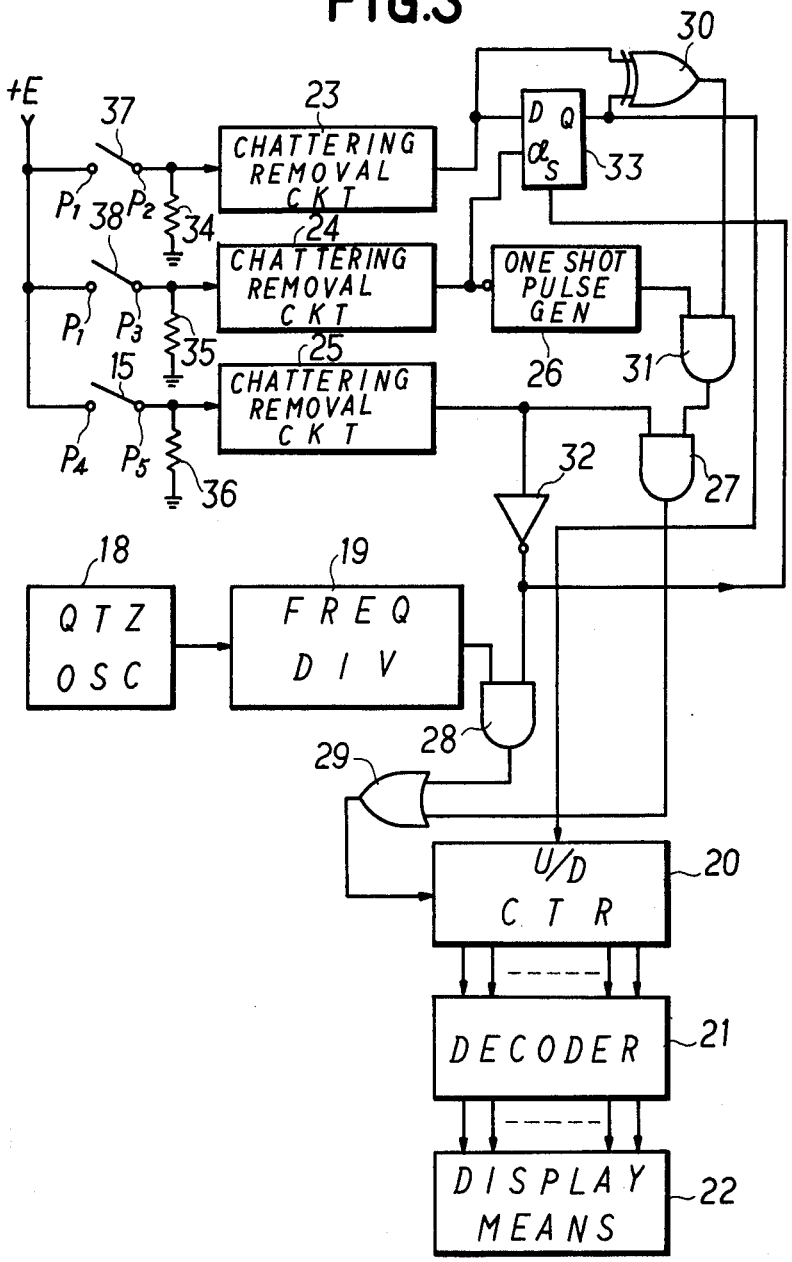
FIG. 3 shows an electric circuit of an electric timepiece constituting the embodiment as shown in FIGS. 1 and 2, FIGS. 4 to 6 are time charts explanatory of the operation of the embodiment as shown in FIGS. 1 to 3, in which the abscissa axis represents time t.

Referring now to FIG. 3, the output frequency from a quartz oscillator 18 is divided by means of a frequency divider 19. An up-and-down counter 20 is adapted to count minutes and hours. The output from the counter 20 is delivered, through a decoder 21, to a display means 22 to display the time.

Reference numerals 23 to 25 each denote a chattering removal circuit, while a one-shot pulse generator is designated at 26. Gate circuits 27 to 31 in combination constitute a controlling means. An inverter is denoted by a numeral 32. A flip-flop circuit 33 constitutes a selecting means. Reference numerals 34 to 36 denote resistors. A switch 37 corresponds to a switch which is constituted by the contact piece 13 and the conductive section 9*a*, while a switch denoted by a numeral 38 correspond to that formed by the contact piece 14 and the conductive section 9*b* of FIG. 1, respectively.

In operation, the knob 1 is usually kept at a depressed position as shown in FIG. 1. In this state, the switch 15 is kept opened, and the output from the chattering removal circuit 25 of FIG. 3 assumes a logical value of "0." Consequently, the gate circuit 28 is kept opened, and the flip-flop circuit 33 is kept in the set condition, so that the up counting mode of the counter 20 is selected by the output Q from the flip-flop circuit 33.

Therefore, the output pulse from the frequency divider 19 is counted, through the gate circuits 28, 29, by the counter 20, the output thereof is delivered through the decoder 21 to the display means 22, thereby to display time.

Hereinafter, an explanation will be made as to the manner in which the contents of the counter 20 are corrected by means of the up counting mode.

At first, the knob 1 as shown in FIG. 1 is pulled, so as to move the rotary body 8 to a position represented by a two-dots-and-dash line a, thereby to close the switch 15. Consequently, the gate circuit 28 of FIG. 3 is closed, while the gate circuit 27 is opened. The contact pieces 13 and 14 contact the conductive sections 9*a* and 9*b*, respectively, as shown in FIG. 2. As the knob 1 is rotated in this state in the direction of an arrow b, the conductive sections 9*a* . . . 9*a* are successively brought into contact with the contact piece 13, and, with a certain time lag, the conductive sections 9*b* . . . 9*b* are brought into contact with the contact piece 14 successively.

Figure 4:
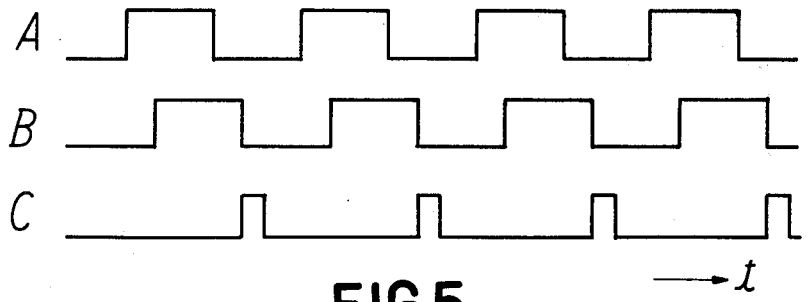

Therefore, the switches 37 and 38 in FIG. 3 are opened and closed repeatedly, so that pulses are generated by the chattering removal circuits 23, 24, respectively, as denoted by waveforms A and B of FIG. 4, thereby to hold the output Q from the flip-flop circuit 33 at "1."

At the same time, the one shot pulse generator 26 generates pulses having a waveform C of FIG. 4, upon receipt of the pulses of waveform B of FIG. 4. During the generation of pulses of the waveform C the output from the chattering removal circuit 23 is kept at "0," and the output from the gate circuit 30 is kept at "1," so that the gate 31 is kept opened.

Consequently, the pulse from the one-shot pulse generator 26 is delivered to the counter 20, through the gate circuits 31, 27 and 29, so as to advance the contents of the counter 20 in a stepped manner. Therefore, the counting speed of the counter 20 can optionally be adjusted by means of the speed of rotation of the knob 1. Thus, it becomes possible to increase the speed of forwarding when the time on display is still far from the destined time, by rotating the knob 1 at a relatively high speed, and to reduce the speed of forwarding, so as to prevent the time display from going too far beyond the destined time, through allowing a careful adjustment, by reducing the rotational speed of the knob 1.

For correcting the contents of the couner 20, upon switching the latter for the down counting mode, referring again to FIG. 1, the knob 1 as shown in FIG. 1 is pulled and rotated to drive the rotary body 8 in the opposite direction to that for the foregoing up counting. Therefore, to the contrary of the case of the up counting mode, at first the conductive sections 9*b* . . . 9*b* are brought into contact with the contact piece 14, and, with a certain time lag, the conductive sections 9*a* . . . 9*a* are put in contact with the contact piece 13.

Figure 5:
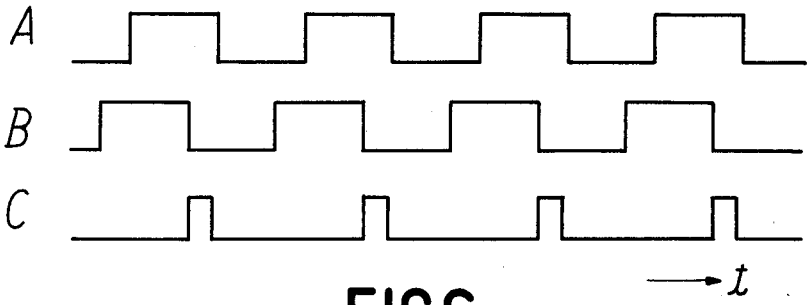

Consequently, waveforms A, B as shown in FIG. 5 are generated from the chattering removal circuits 23, 24, so as to switch the output Q from the flip-flop circuit 33 to "0," thereby to switch the counter 20 to the down counting mode.

On the other hand, the output from the chattering removal circuit 23 is kept at "1," as denoted by the waveform A in FIG. 5, during the generation of the waveform C of FIG. 5, by the one-shot pulse generator 26, so that the output Q from the flip-flop circuit 33 is kept at "0." Consequently, the gate circuit 31 is kept opened by the output from the gate circuit 30, so that the contents of the counter 20 are subtracted by the pulse delivered from the one-shot pulse generator 26.

It will be seen that the up and down operation of the counter 20 can be selected by selecting the direction of rotation of the knob 1, while the speed of forwarding of the counter 20 can optionally be changed by changing the speed of rotation of the knob 1.

Figure 6:
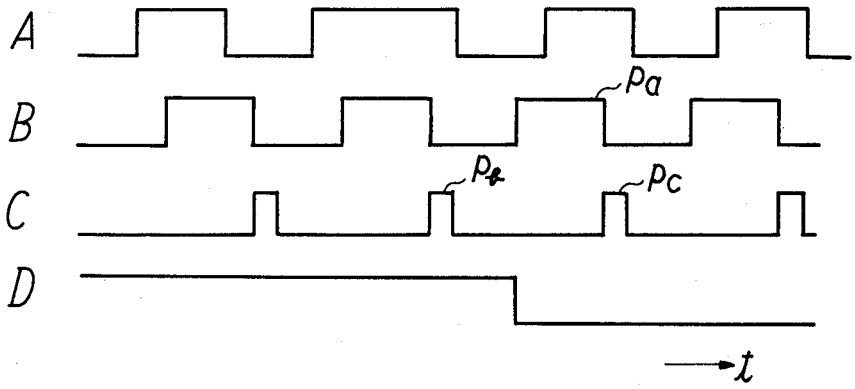

By the way, assuming that the correction has been made by switching the contents of the counter 20 to the up counting mode, too far beyond the destined time, as the knob 1 is reversed from a state in which the contact pieces 13 and 14 are in contact with respective conductive sections 9*a* and 9*b*, waveforms A, B and C as shown in FIG. 6 are generated by the chattering removal circuits 23, 24 and by the one-shot pulse generator 26, respectively.

Meanwhile, the output Q from the flip-flop circuit 33 is inversed as denoted by a waveform D in FIG. 6, by the pulse Pa of the waveform B as shown in FIG. 6. Therefore, for counting down the contents of the counter 20, it is necessary to remove the pulse Pb of the waveform C of FIG. 6 delivered from the one-shot pulse generator 26, and to commence the pulse supply with the pulse Pc. Therefore, when the pulse Pb is generated, the output from the gate circuit 30 is turned to "0," by the output Q from the flip-flop circuit 33 and by the output from the chattering removal circuit 23, so as to close the gate circuit 31, thereby to check the pulse Pb.

Similarly, when reversing the direction of rotation of the knob 1 from the condition of the counting down, the output pulse from the one-shot pulse generator 26 after the inverting of the level of the output Q from the flip-flop circuit 33 is delivered to the counter 20.

In the foregoing embodiment, the rotary body 8 is axially movable. However, this is not exclusive. For instance, the relative positions of the rotary body 8 to the contact pieces 13, 14 may be fixed, so as to ensure the contact of the conductive sections 9*a*, 9*b* with respective contact pieces 13, 14, without requiring the axial movement of the rotary body. However, in this case, a separate switch has to be incorporated for switching the clock between a normal time counting mode and the correction mode.

Figure 7:
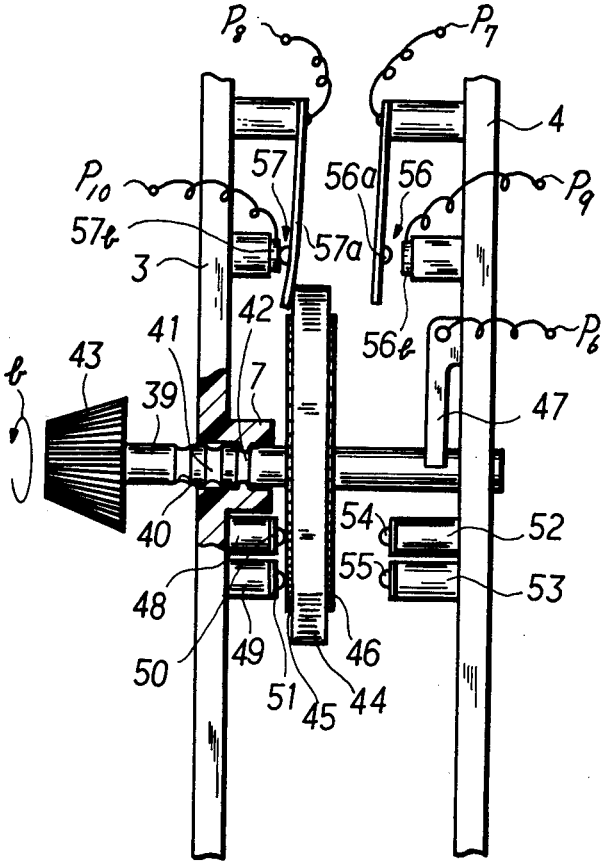
FIG. 7 is a partially-sectioned front elevational view of pulse generating means constituting a part of another embodiment of the invention.

Refering now to FIG. 7 showing another embodiment of the invention, click grooves 40–42 are formed on a shaft 39 to the end of which attached is a knob 43. Further, a disc-shaped rotary body 44 is fixed to the shaft 39. Conductive parts 45 . . . 45 are formed on one surface of the rotary body 44. As will be seen from FIG. 8, each conductive part 45 consists of a conductive section 45*a* and a conductive section 54*b* which are unitary but slightly deviated from each other in the circumferential direction. Also, conductive parts 46 . . . 46 consisting of conductive sections (not shown), which are similar to conductive sections 45*a* . . . 45*a*, 45*b* . . . 45*b* of the conductive parts 45, are formed on the other side of the rotary body 44.

The conductive parts 45 . . . 45 and the conductive parts 46 . . . 46 are electrically connected to the shaft 38, and are connected to a source (not shown) through a brush 47 and a terminal $P_6$.

Figure 8:
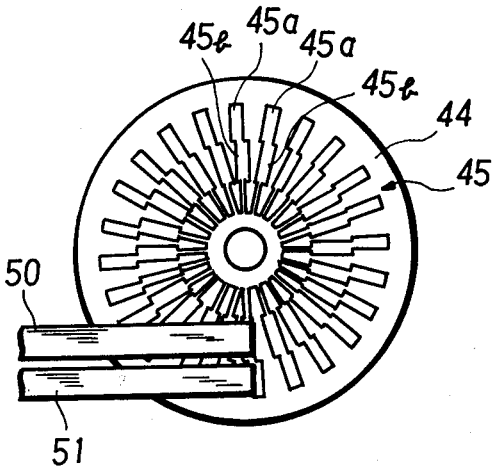
FIG. 8 is an enlarged front elevational view of an essential part of the pulse generating means as shown in FIG. 7, and FIGS. 9A and 9B show an electric circuit for an electronic timepiece, for another embodiment of the invention.

Contact pieces 50, 51 are supported at their one ends by means of columns 48, 49 which are provided on the support plate 3. As shown in FIG. 8, the contact pieces 50, 51 contact at their one ends the conductive sections 45*b* . . . 45*b* and 45*a* . . . 45*a*, respectively. The contact pieces 50 and 51 are grounded through respective resistors. Contact pieces 54, 55 supported by columns 52, 53, which are provided on the support plate 4, are similar to the contact pieces 50, 51, and are disposed to confront the conductive parts 46 . . . 46. Contact pieces 56*a*, 57*a* of the switches 56, 57 are grounded through terminals $P_7$ and $P_8$, and through resistors, while contacts 56*b*, 57*b* of the switches 56 and 57 are connected to the source through terminals $P_9$ and $P_{10}$.

Figure 9A:
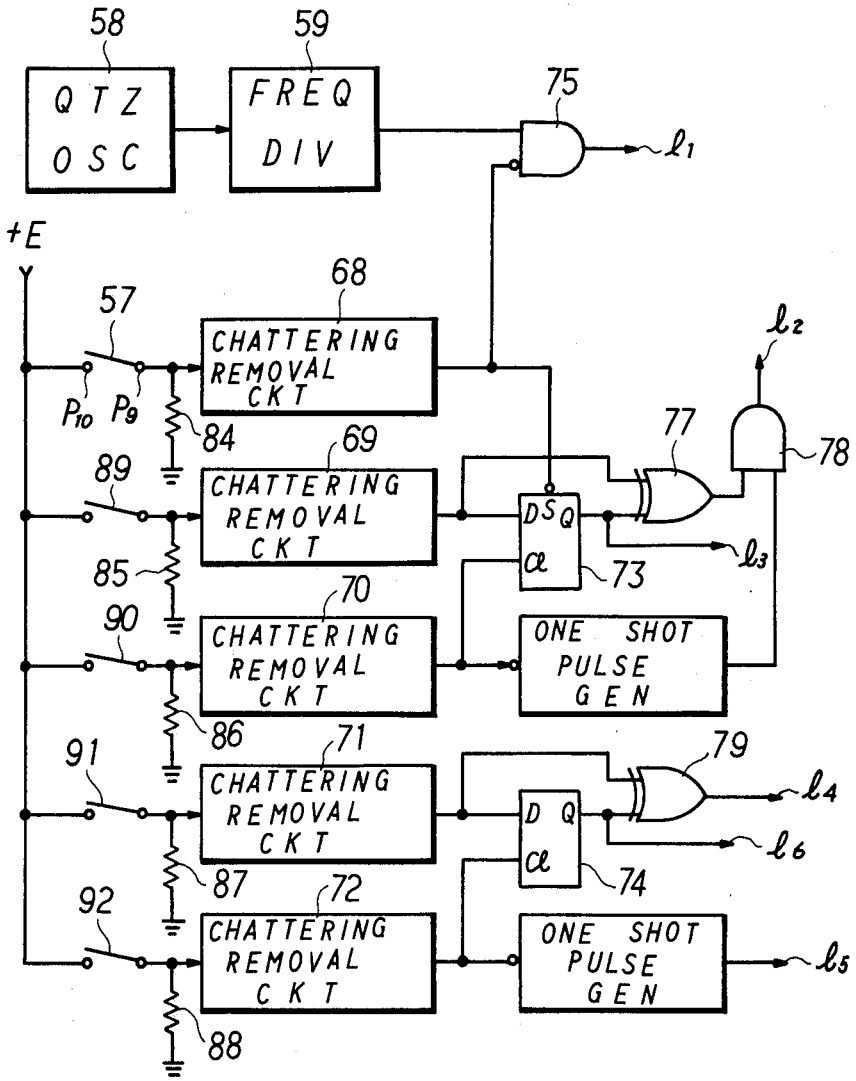
Figure 9B:
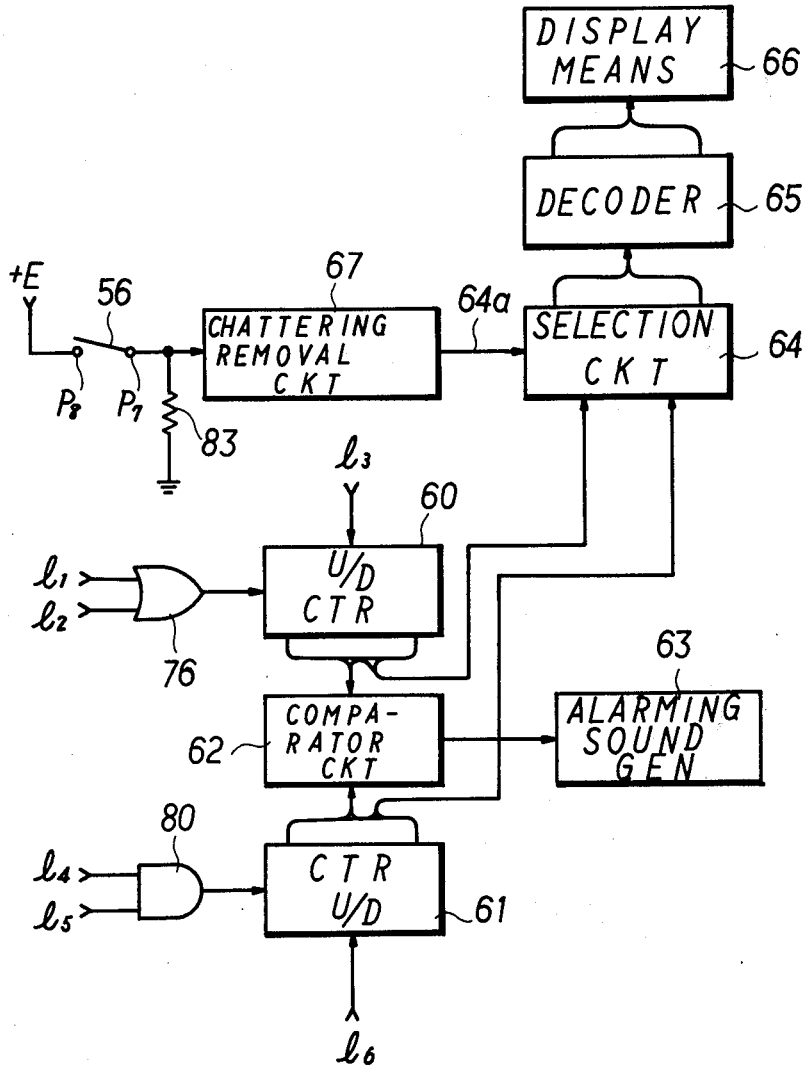

Referring now to FIG. 9, the output frequency of a quartz oscillator 58 is divided by a frequency divider 59, down to a predetermined frequency. An up-and-down counter 60 counts minutes and hours, while the predetermined time is set in another up-and-down counter 61. A comparator circuit 62 is adapted to compare the output of the counters 60 and 61 with each other, so as to drive an alarming sound generator 63, when these outputs come to coincide with each other.

A selection circuit 64 is constituted by gate circuits, and is adapted to selectively deliver either one of the outputs from the counters 60 and 61 to the decoder 65, in response to the logical value available at the input terminal 64*a*. The display means 66 is adapted to perform the time display in accordance with the output from the decoder 65. Reference numerals 67–72 denote chattering removal circuits; 73, 74 denote flip-flop circuits which constitute, respectively, the first and the second selecting means; 75–80 denote gate circuits constituting a controlling means; 81, 82 denote one-shot pulse generators; and 83–88 denote resistors.

Switches 89 and 90 are constituted by the contact piece 51 and the conductive sections 45*a* . . . 45*a* and by the contact piece 50 and the conductive sections 45*b* . . . 45*b*, respectively, of FIG. 8. Similarly, switches 91 and 92 are constituted by the contact piece 55 and the conductive sections of the conductive parts 46 and by the contact piece 54 and the conductive sections of the conductive parts 46, respectively.

In operation, for performing the normal time informing function, the knob 43 as shown in FIG. 7 is depressed one step deeper than the illustrated position. Consequently, the switch 57 is opened to allow the gate circuit 75 to be opened by the output from the chattering removal circuit 68. At the same time, the flip-flop circuit 73 is held at the setting condition, so that the up counting mode of the counter 60 is selected.

The output pulse from the frequency divider circuit 59 is delivered to the counter 60, through the gate circuits 75 and 76, so as to cause an up counting. At the same time, since the switch 56 is kept opened, the selecting circuit 64 is selecting the output from the counter 60, by the output from the chattering removal circuit 67. Therefore, the contents of the counter 60, i.e. the present time are displayed on the display means 66, through the decoder 65.

For correcting the contents of the counter 60, at first the knob 43 of FIG. 7 is pulled to the illustrated position to close the switch 57, thereby to put the conductive sections 45*a* and 45*b* into contact with respective contact pieces 51 and 50. For counting up the contents of the counter 60, the knob 43 is rotated in the direction of an arrow b, so as to bring the conductive sections 45*a* . . . 45*a* into contact with the contact pieces 51 successively. Also, with a certain time lag, the conductive sections 45*b* . . . 45*b* are brought into contact with the contact piece 50 successively. Therefore, after the switch 89 of FIG. 9 has been closed, the switch 90 is closed to hold the level of the output Q from the flip-flop circuit 73 at "1."

Meanwhile, a pulse is generated by the one-shot pulse generator 81, upon opening and closing of the switch 90, so that the counter 60 is advanced in a stepped manner and corrected, in the same manner as that of the foregoing embodiment.

For counting down the contents of the counter 60, the knob 43 is rotated in the opposite direction to that of the counting up mode, so as to inverse the level of the output Q from the flip-flop circuit 73 to "0," thereby to switch the counter 60 to the down counting mode.

Hereinafter, an explanation will be made as to the setting of the predetermined time. To this end, the knob 43 is depressed by two steps to put the claw 7 into engagement with the groove 40, and to close the switch 56, as well as to make the contact pieces 54, 55 engageable with and disengageable from the conductive part 44. As the switch 56 is closed, the output from the counter 60 is delivered through the selection circuit 64 and displayed on the display means 66.

Then, by rotating the knob 43 in the direction of the arrow b, the output Q from the flip-flop circuit 74 is feld at "1," and the contents of the counter 61 are advanced, so as to allow the user to set the predetermined time upon obseration of the display.

For counting down the contents of the counter 61, the knob 43 is reversed to switch the counter 61 to the down counting mode, so as to effect the subtraction.

As mentioned before, an output is delivered from the comparator circuit 62, when the contents of the counters 60 and 61 come to coincide with each other, thereby to drive the alarming sound generator 63.

Although this embodiment has been described as incorporating a disk-shaped rotary body, the latter may be substituted by a drum-like rotary body as shown in FIG. 1. In this case, the switching between the setting of predetermined time and the correction of the time is made by a manually operable switch.

As an alternative measure, the conductive sections 9*a*, 9*b* formed on the drum-like rotary body are made longer, while three click portions are formed on the shaft 2, so as to make the contact pieces 13, 14 engageable with and disengageable from the conductive sections *9a, 9b,* at respective positions. In this case, a switch adapted to be closed when the rotary body is depressed to the innermost position and another switch adapted to be closed when the rotary body is extracted to the outermost position are provided. The arrangement is such that the normal time informing function is performed when the switch is kept opened. In addition, the up-and-down counter for the setting of predetermined time is selected when one of these switches is closed, while the up-and-down counter for the present time is selected when the other switch is closed, so as to allow the setting of the predetermined time and the correction of the time display, respectively.

In the foregoing two embodiments, the arrangement may be such that the frequency divider, as well as the counters of the previous stage or the like are reset by means of the switch for switching the normal time informing mode to the time correcting mode, after the correction of the time.

Also, the conductive sections deviated from each other in the circumferential direcrion may be formed independently from each other, insteadly of the unitary construction.

At the same time, the switch in the foregoing embodiments constituted by a contact piece adapted to be pressed in accordance with an axial movement of the rotary body and a cooperating contact piece is not exclusive, and the switch may be constituted by other members such as an electrode disposed along the periphery of the drum-like rotary body and a contact piece adapted to be contacted by the electrode as a result of an axial movement of the rotary body. Further, instead of disposing the conductive sections with slight deviation from each other in the circumferential direction, the contact pieces may be displaced from each other in the circumferential direction.

As has been described, in the device of the invention, pulses are generated by means of contact pieces and a plurality of conductive parts formed on the periphery of a rotary body, in accordance with the rotation of the rotary body, and are delivered to the up-and-down counter for counting the time. At the same time, up counting or down counting mode of the counter is selected by selecting the direction of rotation of the rotary body.

Therefore, the contents of the up-and-down counter may be put ahead or aback by quote a simple operation, and, in addition, the speed of the change of the contents can be increased or decreased optionally, so as to allow a prompt correction of the time.

Further, by making the rotary body axially movable, and allowing the same to generate the pulse signals by a rotation thereof at respective axial positions, the up-and-down counter whose contents are to be changed can easily be selected from a plurality of counters. This arrangement conveniently allows the selection of modes such as correction of time display, setting of the predetermined time, and so forth.

Further, by providing a switch which is adapted to be opened and closed in accordance with the axial movement of the rotary body, the reference time signal and the pulse signals are selectively supplied to the up-and-down counter, so as to afford a switching between the normal time informing mode and the time correcting mode.

What is claimed is:

1. A time correcting device for electronic timepiece comprising: a rotary means mounted to be rotated around an axis by manual operation; a pulse generating means for generating a plurality of pulse trains in accordance with the rotation of said rotary means with the phase between at least two of said pulse trains obtained when said rotary means is rotated in one direction being different from that obtained when said rotary means is rotated in the other direction; controlling means for selecting one of a time reference signal and the pulse trains and providing a corresponding output; an up-and-down counter operable to count pulses upon receipt of the output from said controlling means; and selecting means for selecting one of the up counting mode and the down counting mode of said up-and-down counter upon detecting the phase differential of the pulse trains from said controlling means.

2. A time correcting device as claimed in claim 1, wherein said pulse generating means comprises a plurality of conductive parts disposed on said rotary means, and a plurality of contact pieces disposed so as to be brought into and out of contact with said conductive parts in accordance with the rotation of said rotary means thereby to produce the pulse trains.

3. A time correcting device as claimed in claim 1, further including means mounting said rotary means for movement in the axial direction by manual operation.

4. A time correcting device as claimed in claim 2, wherein each of said conductive parts comprises a plurality of conductive segments disposed to be brought into and out of contact with said contact piece in a predetermined order when said rotary body is rotated in one direction, and in the reverse order when said rotary means is rotated in the other direction.

5. A time correcting device as claimed in claim 2, wherein each of said conductive parts comprises one of a first set of conductive sections disposed on said rotary means at a constant pitch and disposed to make contact with one of said contact pieces, and one of a second set conductive sections disposed on said rotary means with a certain deviation in the direction of rotation from said first conductive sections and disposed to make contact with the other of said contact pieces.

6. A time correcting device as claimed in claim 3, further including switch means operable to be opened and closed in accordance with the axial movement of said rotary means, so as to control said controlling means.

7. A time correcting device as claimed in claim 3, wherein said pulse generating means includes means for generating a plurality of pulse trains in accordance with the rotation of said rotary means at a first and a second axial position of said rotary means with the phase between at least two of said pulse trains obtained when said rotary means is rotated in one direction being different from that obtained when said rotary means is rotated in the other direction; controlling means for selecting either one of the pulse trains obtained when said rotary means is positioned at the first position and a time reference signal and providing a corresponding output; said up-and-down counter being operable to count pulses upon receipt of the output from said controlling means; another up-and-down counter for setting a predetermined time upon receipt of the pulse trains obtained when said rotary means is positioned at the second position; said selecting means being operable to select one of the up counting mode and the down counting mode of said first-mentioned up-and-down counter upon detecting the phase differential of the pulse trains from said controlling means when said rotary means is positioned at the first position; and another selecting means for selecting one of the up counting mode and the down counting mode of said another up-and-down counter upon detecting the phase differential of the pulse trains from said controlling means when said rotary means is positioned at the second position.

* * * * *